US009255379B2

(12) United States Patent
Yoshimura et al.

(10) Patent No.: US 9,255,379 B2
(45) Date of Patent: Feb. 9, 2016

(54) MOTOR GRADER

(71) Applicant: KOMATSU LTD., Tokyo (JP)

(72) Inventors: Masashi Yoshimura, Komatsu (JP); Yutaka Ono, Komatsu (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 14/114,562

(22) PCT Filed: Jun. 18, 2013

(86) PCT No.: PCT/JP2013/066676

§ 371 (c)(1),
(2) Date: Oct. 29, 2013

(87) PCT Pub. No.: WO2014/203323

PCT Pub. Date: Dec. 24, 2014

(65) Prior Publication Data

US 2014/0367129 A1 Dec. 18, 2014

(51) Int. Cl.
*E02F 3/76* (2006.01)
*E02F 3/80* (2006.01)

(52) U.S. Cl.
CPC ..... *E02F 3/764* (2013.01); *E02F 3/765* (2013.01); *E02F 3/7645* (2013.01); *E02F 3/7654* (2013.01); *E02F 3/80* (2013.01)

(58) Field of Classification Search
CPC ..... E02F 3/80; E02F 3/844; E02F 3/653; E02F 3/7636; E02F 3/7668; E02F 3/7677; E02F 3/764; E02F 3/765; E02F 3/7645; E02F 3/7654
USPC ..... 172/793, 745, 753, 819; 280/781
See application file for complete search history.

(56) References Cited

U.S. PATENT DOCUMENTS

| | | | | |
|---|---|---|---|---|
| 1,547,263 | A * | 7/1925 | Pomeroy | 180/312 |
| 2,247,982 | A * | 7/1941 | Arndt | 172/793 |
| 2,655,743 | A * | 10/1953 | Ross | 172/793 |
| 3,327,413 | A * | 6/1967 | Brinkmeyer et al. | 172/785 |
| 4,696,350 | A | 9/1987 | Ruhter et al. | |
| 5,741,026 | A * | 4/1998 | Bonnville | 280/781 |

(Continued)

FOREIGN PATENT DOCUMENTS

| | | |
|---|---|---|
| DE | 198 82 547 B4 | 11/2007 |
| JP | 45-36984 B2 | 11/1970 |

(Continued)

OTHER PUBLICATIONS

International Search Report for PCT/JP2013/066676, issued on Jul. 16, 2013.

(Continued)

*Primary Examiner* — Robert Pezzuto
*Assistant Examiner* — Jessica H Lutz
(74) *Attorney, Agent, or Firm* — Global IP Counselors, LLP

(57) ABSTRACT

A motor grader includes a frame and a work implement. The frame is box-shaped. The work implement is configured to be supported by the frame. The frame includes a bracket, a first frame part and a second frame part. The bracket has left and right side surfaces with which a lifter guide is formed in an integrated manner. The first frame part is configured to extend forward from a front end part of the bracket and support the work implement. The second frame part is configured to extend rearward from a rear end part of the bracket.

13 Claims, 9 Drawing Sheets

(56) References Cited

U.S. PATENT DOCUMENTS

| | | | | |
|---|---|---|---|---|
| 6,010,155 | A * | 1/2000 | Rinehart | 280/781 |
| 6,299,240 | B1 * | 10/2001 | Schroeder et al. | 296/203.01 |
| 6,508,019 | B1 | 1/2003 | Sasaki et al. | |
| 8,424,912 | B2 * | 4/2013 | Favaretto | 280/781 |
| 2002/0170212 | A1 | 11/2002 | Sasaki et al. | |
| 2008/0122265 | A1 * | 5/2008 | Meier | 296/204 |
| 2008/0185162 | A1 | 8/2008 | Maeda | |
| 2013/0175064 | A1 * | 7/2013 | Yamazaki | 172/796 |
| 2013/0206432 | A1 * | 8/2013 | Staade et al. | 172/789 |

FOREIGN PATENT DOCUMENTS

| | | | |
|---|---|---|---|
| JP | 59-10360 | U | 1/1984 |
| JP | 62-99525 | A | 5/1987 |
| WO | 2007/015376 | A1 | 2/2007 |
| WO | 2012165014 | A1 | 12/2012 |

OTHER PUBLICATIONS

The Office Action for the corresponding German patent application No. 11 2013 000 113.6 issued on Sep. 24, 2014.

* cited by examiner

MOTOR GRADER

CROSS-REFERENCE TO RELATED APPLICATIONS

This application is a U.S. National stage application of International Application No. PCT/JP2013/066676, filed on Jun. 18, 2013.

BACKGROUND

1. Field of the Invention

The present invention relates to a motor grader equipped with work implement.

2. Background Information

Generally, a motor grader is provided with a frame, work implement disposed below the frame, a lifter guide fixed to the frame, a lifter bracket that surrounds the lifter guide, and a lift cylinder that couples the lifter bracket and the work implement (see for example WO 2007/015376). The lifter guide in WO 2007/015376 is formed as a ring and the inner diameter of the lifter guide is suitably larger than the outer diameter of the frame. The lifter guide is fixed to the frame by welding from the distal end of the frame through the lifter guide to the outer circumference of the frame at a certain position.

SUMMARY

However, while the lifter guide needs to be inserted through the frame in WO 2007/015376, improving the positional accuracy of the lifter guide with respect to the frame is difficult since it is not easy to weld the lifter guide at the certain position of the frame at a certain angle.

Moreover, since a plate member needs to be inserted for filling in the gap between the lifter guide and the frame when welding the lifter guide to the frame, easily fixing the lifter guide to the frame is not possible.

In consideration of the above conditions, an object of the present invention is to provide a motor grader for which the lifter guide can be accurately and easily fixed to the frame.

A motor grader according to a first aspect of the present invention is provided with a frame and work implement. The frame is formed in a box-shaped. The work implement is configured to be supported by the frame. The frame includes a bracket, a first frame part and a second frame part. The bracket has left and right side surfaces with which a lifter guide formed in an integrated manner. The first frame part is configured to extend forward from a front end part of the bracket and support the work implement. The second frame part is configured to extend rearward from a rear end part of the bracket.

According to the motor grader of the first aspect of the present invention, a device for fixing the lifter guide to the frame is unnecessary since there is no need to insert the lifter guide through the frame. Moreover, since the lifter guide is positioned by coupling the bracket to the first and second frame parts, the positional accuracy of the lifter guide on the frame can be improved. Further, there is no need to provide a plate member for filling in the gap between the lifter guide and the frame since the lifter guide is fixed to the bracket. Due to the above configuration, the lifter guide can be fixed to the frame with good accuracy and with ease.

The motor grader according to a second aspect of the present invention is related to the first aspect, the lifter guide and the bracket are a cast metal.

Based on the motor grader according to the second aspect of the present invention, the strength of the attachment of the lifter guide to the frame can be improved in comparison to when the lifter guide is welded to the bracket.

The motor grader according to a third aspect of the present invention is related to the first or second aspect, and further includes a first bead part that is configured to connect the bracket and the first frame part. The first portion is configured to extend in a crosswise direction and connect a top surface of the bracket and a top surface of the first frame part. The second portion is configured to extend in the crosswise direction and connect a bottom surface of the bracket and a bottom surface of the first frame part. The third portion is configured to extend in a vertical direction and connect the side surface of the bracket and a side surface of the first frame part. The first portion and the second portion are separated from each other in a front-back direction of the frame.

Based on the motor grader according to the third aspect of the present invention, the concentration of an external force applied to the lifter guide on the first bead part is suppressed in comparison to when the first to third portions are formed in a linear manner when seen from the side. Specifically, when conducting slope face shaping work for shaping slopes and ditch digging work for digging V-shaped ditches by applying the blade angle to the ground and using that angle, the torsional force can be suppressed when the torsional force acts on the frame due to the force applied from the blade onto the frame being asymmetrical.

The motor grader according to a fourth aspect of the present invention is related to the third aspect, first portion is located further toward the front of the frame than the second portion.

Based on the motor grader according to the fourth aspect of the present invention, the concentration of the external force on the first bead part can be suppressed.

The motor grader according to a fifth aspect of the present invention is related to the fourth aspect, the lifter guide is connected to the bracket with a top part of the lifter guide bent forward. A distance of the first portion from an intersection between a projection plane of the lifter guide on to the bracket and a top surface of the bracket is equal to a distance of the second portion from an intersection between a projection plane of the lifter guide on to the bracket and a bottom surface of the bracket.

Based on the motor grader according to the fifth aspect of the present invention, the concentration of the external force on the first bead part can be suppressed.

The motor grader according to a sixth aspect of the present invention is related to any one of the third to fifth aspects, third portion is separated from the first portion and the second portion in the front-back direction.

Based on the motor grader according to the sixth aspect of the present invention, the concentration of the external force on the first bead part can be suppressed in comparison to when the first portion and the second portion are coupled in a linear manner when seen from the side.

The motor grader according to a seventh aspect of the present invention is related to any one of the third to sixth aspects, an outer surface of the first bead part is coupled in a flat manner with an outer surface of the bracket and an outer surface of the first frame part.

Based on the motor grader according to the seventh aspect of the present invention, the concentration on the first bead part of the external force applied to the lifter guide can be suppressed in comparison to when the outer surface of the first bead part projects from the outer surfaces of the bracket and the first frame part.

The motor grader according to an eighth aspect of the present invention is related to the first or second aspect, and further includes a second bead part that is configured to connect the bracket and the second frame part. The second bead part includes a fourth portion, a fifth portion and a sixth portion. The fourth portion is configured to extend in a crosswise direction and connect a top surface of the bracket and a top surface of the second frame part. The fifth portion is configured to extend in the crosswise direction and connect a bottom surface of the bracket and a bottom surface of the second frame part. The sixth portion is configured to extend in a vertical direction and connect the side surface of the bracket and a side surface of the second frame part. The fourth portion and the fifth portion are separated from each other in a front-back direction of the frame.

Based on the motor grader according to the eighth aspect of the present invention, the concentration of an external force applied to the lifter guide on the second bead part is suppressed in comparison to when the fourth to sixth portions are formed in a linear manner when seen from the side. Specifically, when conducting slope face shaping work for shaping slopes and ditch digging work for digging V-shaped ditches by applying the blade angle to the ground and using that angle, a torsional force can be suppressed while the torsional force acts on the frame due to the force applied from the blade onto the frame being asymmetrical.

The motor grader according to a ninth aspect of the present invention is related to the eighth aspect, the fourth portion is located further toward the front of the frame than the fifth portion.

Based on the motor grader according to the ninth aspect of the present invention, the concentration of the external force on the second bead part can be suppressed.

The motor grader according to a tenth aspect of the present invention is related to the ninth aspect, the lifter guide is connected to the bracket with a top part of the lifter guide bent forward. A distance of the fourth portion from an intersection between a projection plane of the lifter guide on to the bracket and a top surface of the bracket is equal to a distance of the fifth portion from an intersection between a projection plane of the lifter guide on to the bracket and a bottom surface of the bracket.

Based on the motor grader according to the tenth aspect of the present invention, the concentration of the external force on the second bead part can be suppressed.

The motor grader according to an eleventh aspect of the present invention is related to any one of the eighth to tenth aspects, the sixth portion is separated from the fourth portion and the fifth portion in the front-back direction.

Based on the motor grader according to the eleventh aspect of the present invention, the concentration of the external force on the second bead part can be suppressed in comparison to when the sixth portion is coupled to the fourth portion and the fifth portion in a linear manner when seen from the side.

The motor grader according to a twelfth aspect of the present invention is related to any of the eighth to eleventh aspects, an outer surface of the second bead part is coupled in a flat manner with an outer surface of the bracket and an outer surface of the second frame part.

Based on the motor grader according to the twelfth aspect of the present invention, the concentration on the second bead part of the external force applied to the lifter guide can be suppressed in comparison to when the outer surface of the second bead part projects from the outer surfaces of the bracket and the first frame part.

The motor grader according to a thirteenth aspect of the present invention is related to any one of the first to twelfth aspects, the lifter guide is formed in an annular shape.

Based on the motor grader according to the thirteenth aspect, the strength of the lifter guide can be improved.

The motor grader according to a fourteenth aspect of the present invention is related to any one of the first to thirteenth aspects, the lifter guide is formed on a bottom surface and the right and left surfaces of the bracket.

The motor grader according to a fifteenth aspect of the present invention is related to any one of the first to fourteenth aspects, and further includes a lifter bracket configured to encircle the lifter guide, and a cylinder configured to coupled to the lifter bracket and the work implement.

According to the present invention, a motor grader in which a lifter guide can be accurately and easily fixed to a frame can be provided.

DETAILED DESCRIPTION OF EMBODIMENTS (Full Configuration of Motor Grader 1)

Figure 1:
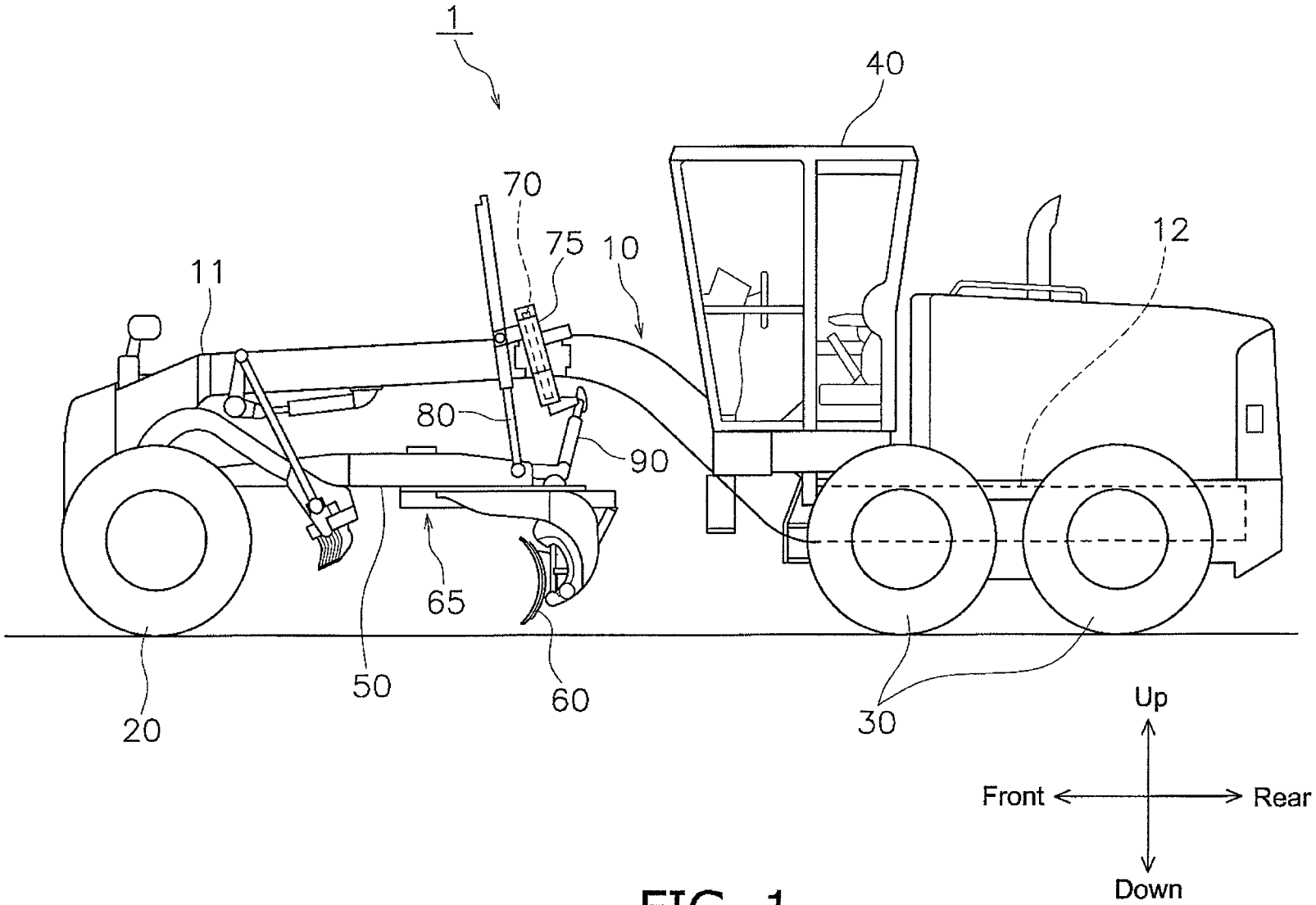
FIG. 1 is a side view of a full configuration of a motor grader.
Figure 2:
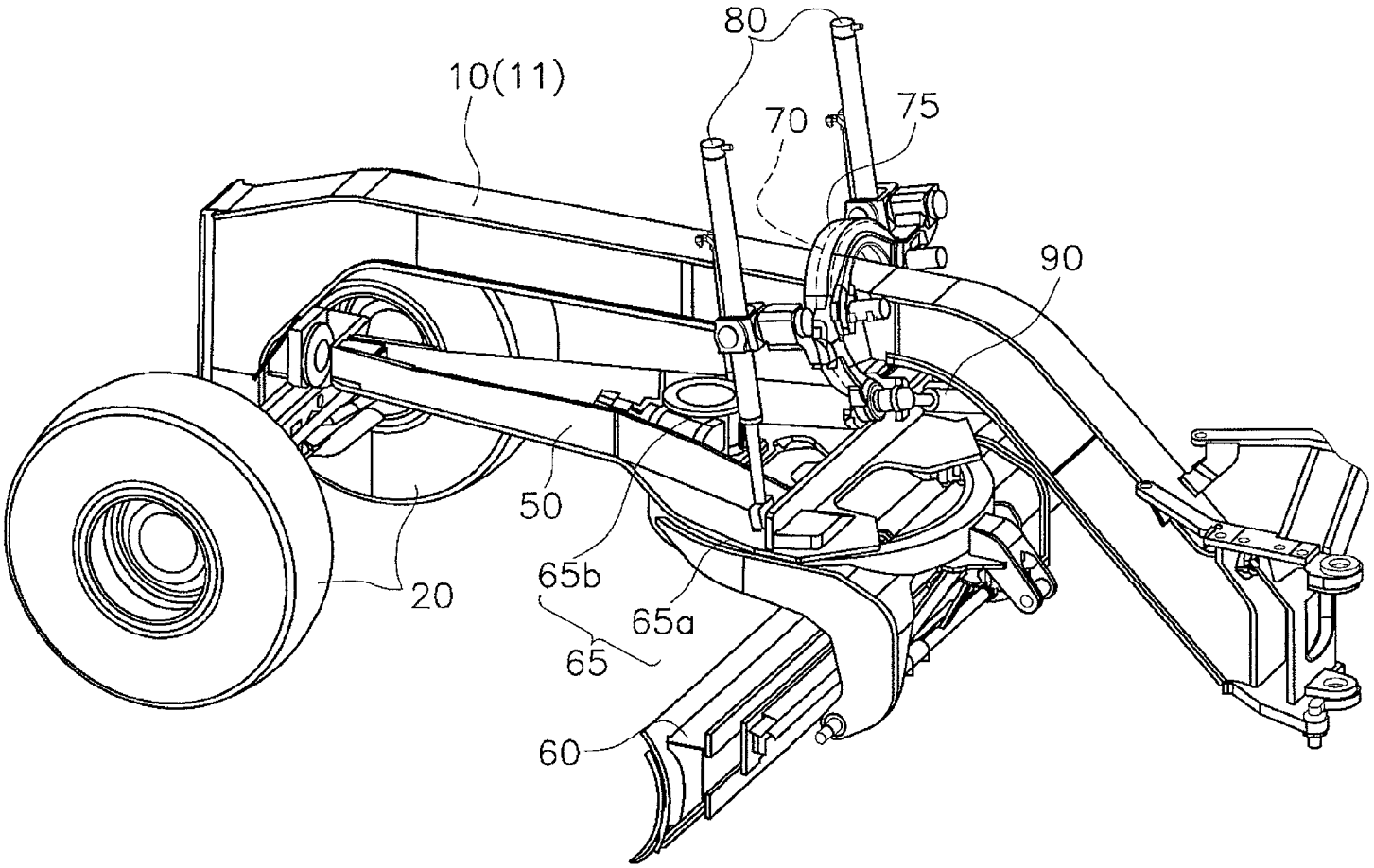
FIG. 2 is an enlarged perspective view of a front part of the motor grader.

FIG. 1 is a side view of a full configuration of a motor grader 1. FIG. 2 is an enlarged perspective view of a front part of the motor grader 1. In the following description, "front," "back," "left," and "right" are terms used on the basis of an operator sitting in the driver's seat.

The motor grader 1 is provided with a frame 10, front wheels 20, rear wheels 30, a cab 40, a draw bar 50, a blade 60, a blade turning device 65, a lifter guide 70, a lifter bracket 75, a pair of lift cylinders 80, and a shift cylinder 90.

The frame 10 is constituted by a front frame 11 and a rear frame 12. The front frame 11 supports the draw bar 50 and the blade 60. A detailed configuration of the front frame 11 is provided below. The rear frame 12 supports an engine and a hydraulic pump and the like which are not shown.

The front wheels 20 are attached to the bottom of the front end of the front frame 11. The rear wheels 30 are attached to the rear frame 12. The cab 40 is disposed on the front frame 11, or may be disposed on the rear frame 12.

The draw bar 50 is disposed below the front frame 11. The draw bar 50 is supported at the front end of the front frame 11 in a manner that allows for vertical swinging. The blade 60 is supported on the rear end part of the draw bar 50 via the blade turning device 65. The blade turning device 65 has a circle 65*a* and a circle turning apparatus 65*b*. The circle 65*a* is supported at the rear end part of the draw bar 50 in a turnable manner. The blade 60 is fixed to the circle 65*a*. The circle turning apparatus 65*b* is disposed on the inside of the circle 65*a*. The blade 60 is able to be turned due to the circle 65*a* being driven with the circle turning apparatus 65*b*. In the present embodiment, the draw bar 50, the blade 60, and the blade turning device 65 are configured as work implement for grading the ground surface.

The lifter guide 70 is fixed to the frame 10. The lifter guide 70 is formed in an annular shape. As described below, the lifter guide 70 is formed in an integrated manner with the frame 10. The lifter bracket 75 is a frame that encompasses the lifter guide 70. The pair of lift cylinders 80 and the shift cylinder 90 are attached to the lifter bracket 75.

The pair of lift cylinders 80 are coupled to the draw bar 50 and the lifter bracket 75. The blade 60 is able to be moved up and down due to the shrinking and expanding of the pair of lift cylinders 80. The shift cylinder 90 is coupled to the draw bar 50 and the lifter bracket 75. The draw bar 50 is able to be moved to the left and right due to the shrinking and expanding of the shift cylinder 90.

(Configuration of Front Frame 11)

Figure 3:
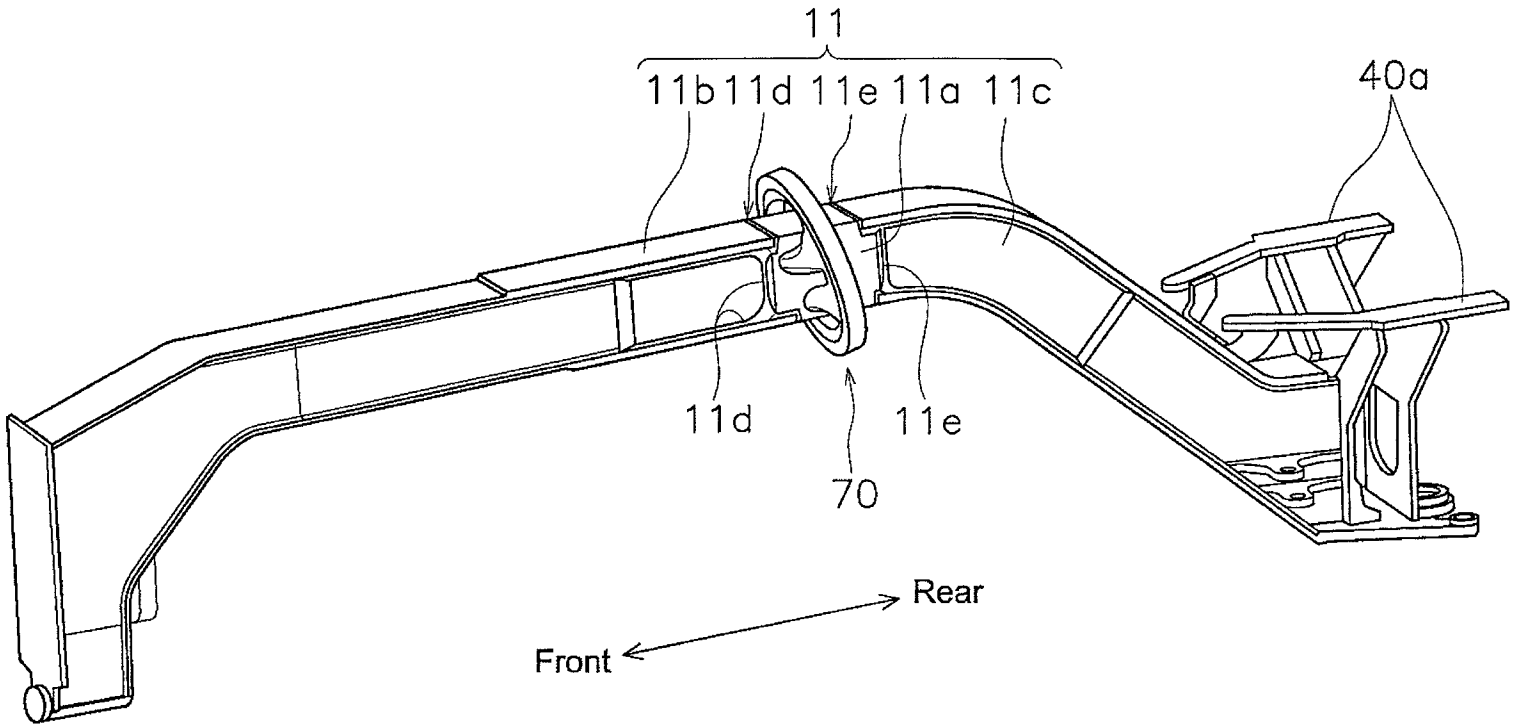
FIG. 3 is a perspective view front of a front frame.
Figure 4:
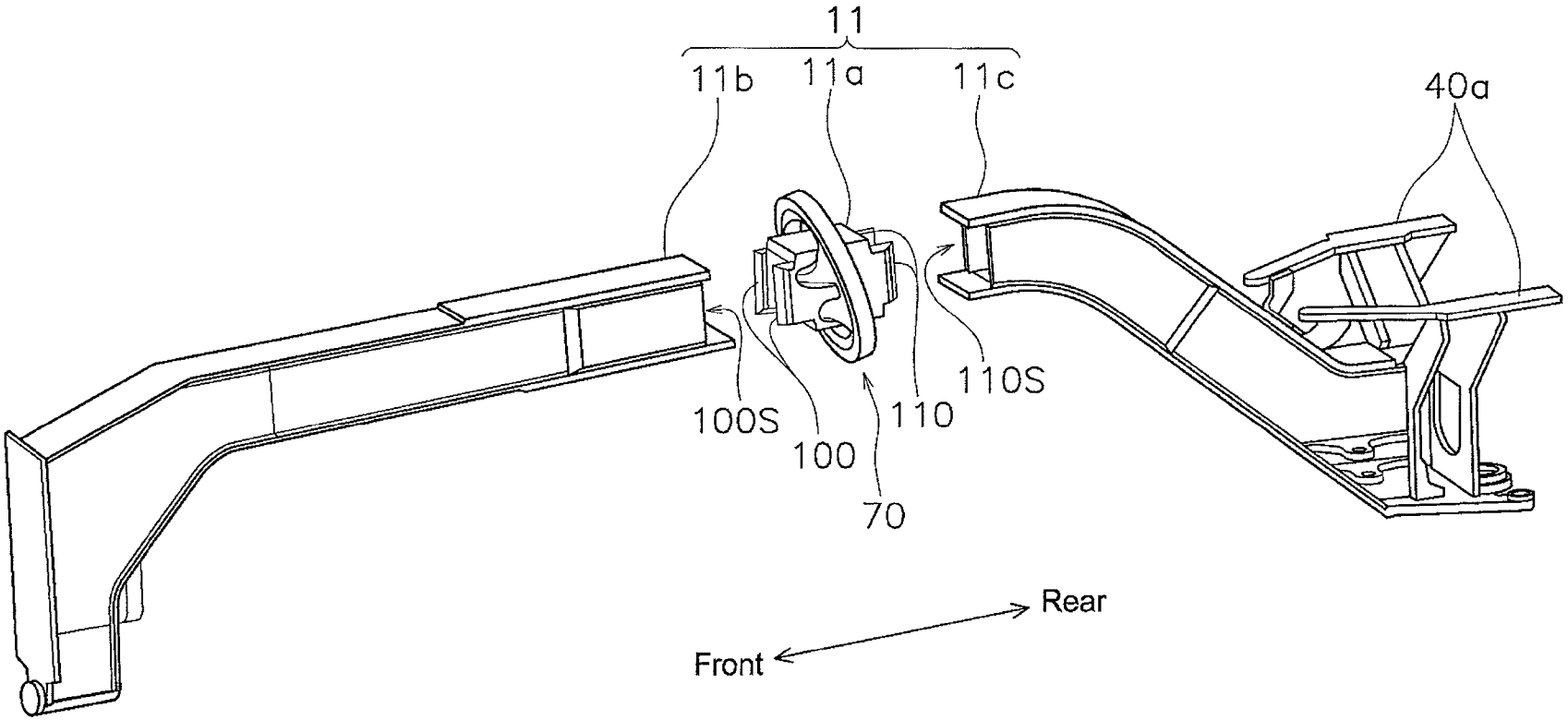
FIG. 4 is an exploded perspective view of the front frame as seen from the front.

FIG. 3 is a perspective view of the front frame 11 as seen from the front. FIG. 4 is an exploded perspective view of the front frame 11 as seen from the front.

The front frame 11 is formed in a box shape. The front frame 11 includes a bracket 11*a*, a first frame part 11*b*, a second frame part 11*c*, a first bead part 11*d*, and a second bead part 11*e*.

The bracket 11*a* is interposed between the first frame part 11*b* and the second frame part 11*c*. The right and left side surfaces and the bottom surface of the bracket 11*a* are connected to the lifter guide 70. In the present embodiment, the bracket 11*a* and the lifter guide 70 are an integrally formed cast metal. Specifically, the bracket 11*a* and the lifter guide 70 are formed in an integrated manner by a casting method. The bracket 11*a* includes a pair of forward projecting parts 100 and a pair of rearward projecting parts 110 as illustrated in FIG. 4. The pair of forward projecting parts 100 and the pair of rearward projecting parts 110 are formed by the extension of both side plates in the forward and rearward directions.

The first frame part 11*b* is coupled to the front end part of the bracket 11*a*. The first frame part 11*b* extends from the front end part of the bracket 11*a* toward the front. The first frame part 11*b* supports the abovementioned work implement. The first frame part 11*b* includes a pair of recessed parts 100S formed at the rear ends of both side plates. The pair of forward projecting parts 100 of the bracket 11*a* are inserted into the pair of recessed parts 100S.

The second frame part 11*c* is coupled to the rear end part of the bracket 11*a*. The second frame part 11*c* extends from the rear end part of the bracket 11*a* toward the rear. A cab supporting part 40*a* for supporting the cab 40 is attached to the rear end part of the second frame part 11*c*. The second frame part 11*c* includes a pair of recessed parts 110S formed at the front ends of both side plates. The pair of pair of rearward projecting parts 110 of the bracket 11*a* are inserted into the pair of recessed parts 110S.

The first bead part 11*d* connects the bracket 11*a* and the first frame part 11*b*. The second bead part 11*e* connects the bracket 11*a* and the second frame part 11*c*. The first bead part 11*d* and the second bead part 11*e* are formed by arc welding.

Figure 5:
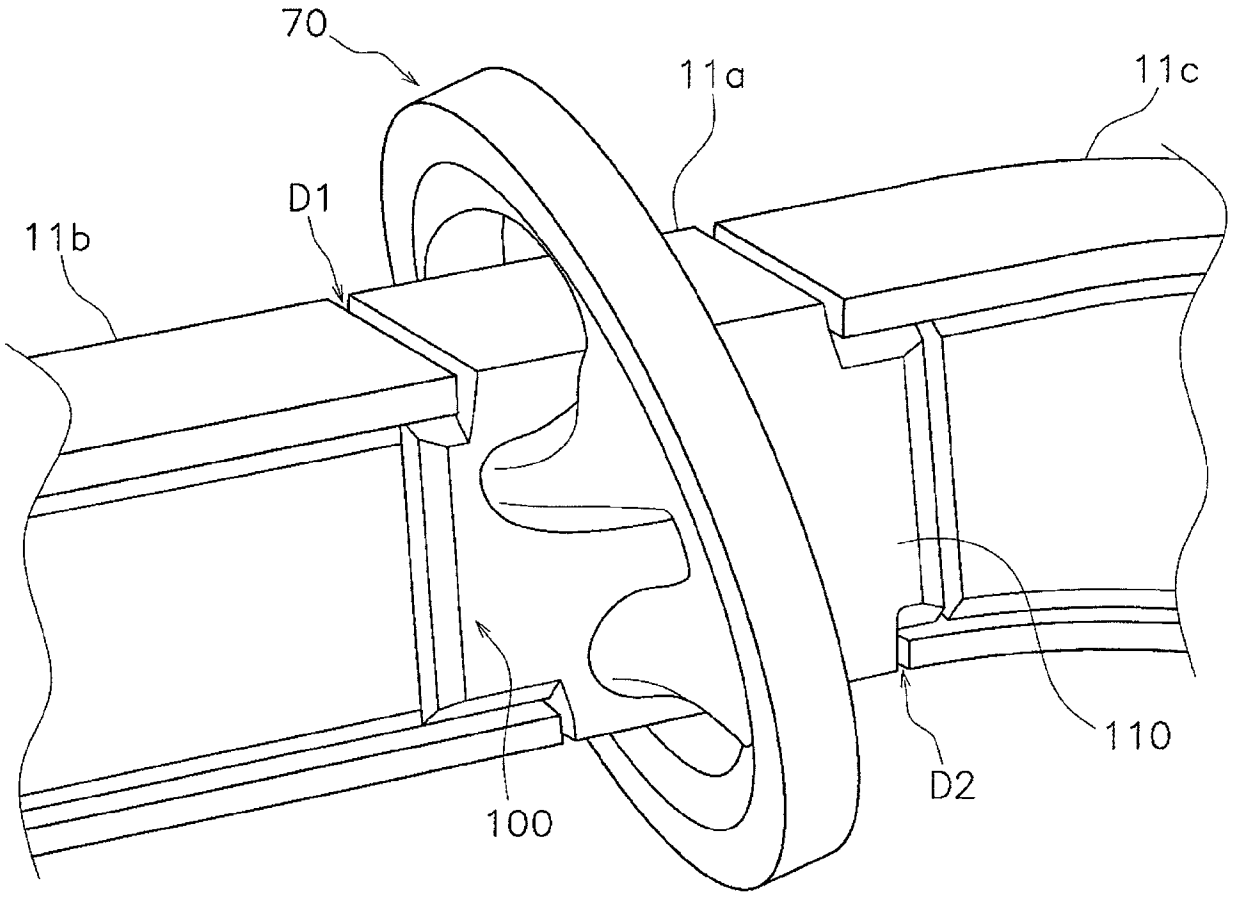
FIG. 5 is a perspective view of a state in which first and second frame parts are coupled with a bracket.
Figure 6:
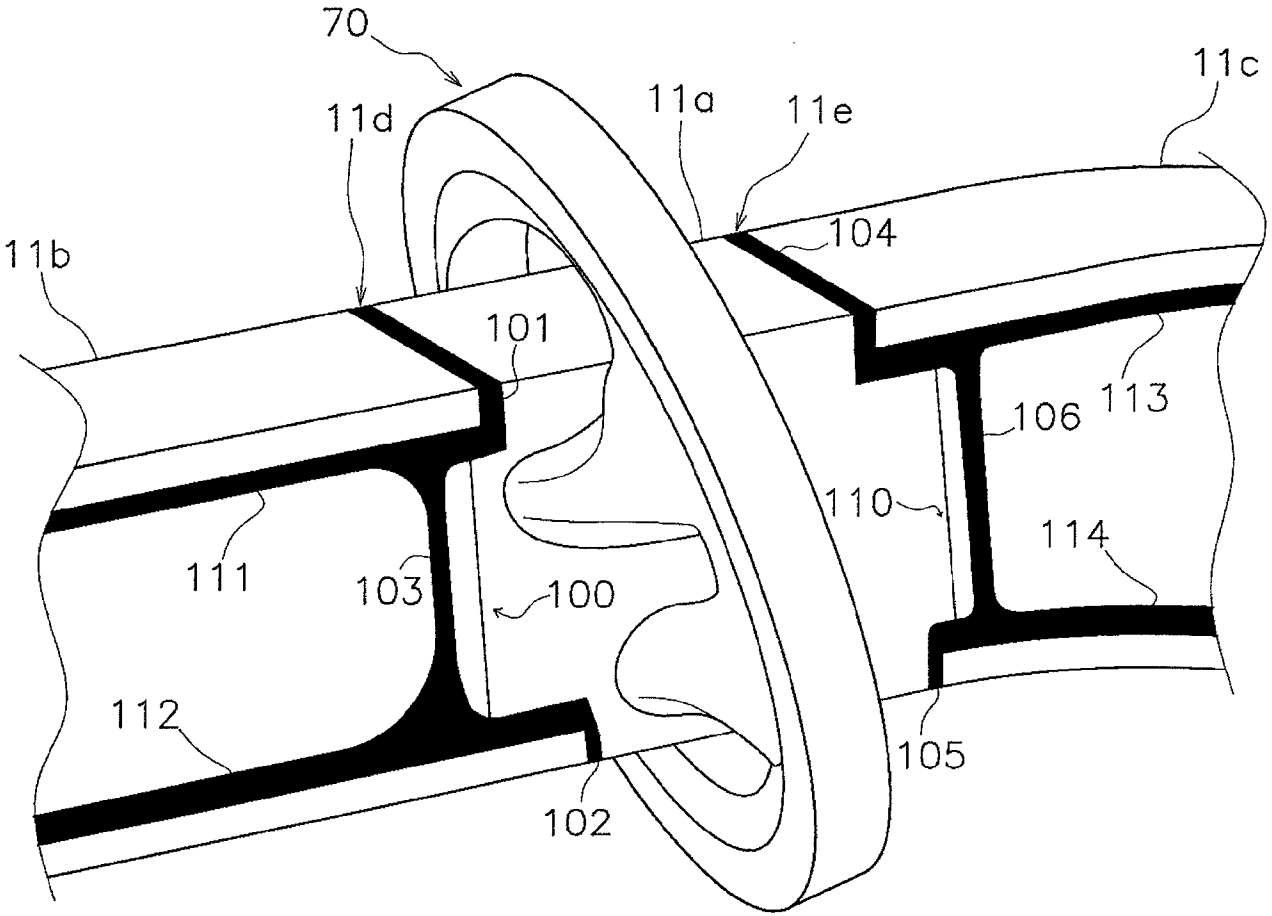
FIG. 6 is a perspective view of a state in which the first and second frame parts are welded to the bracket.
Figure 7:
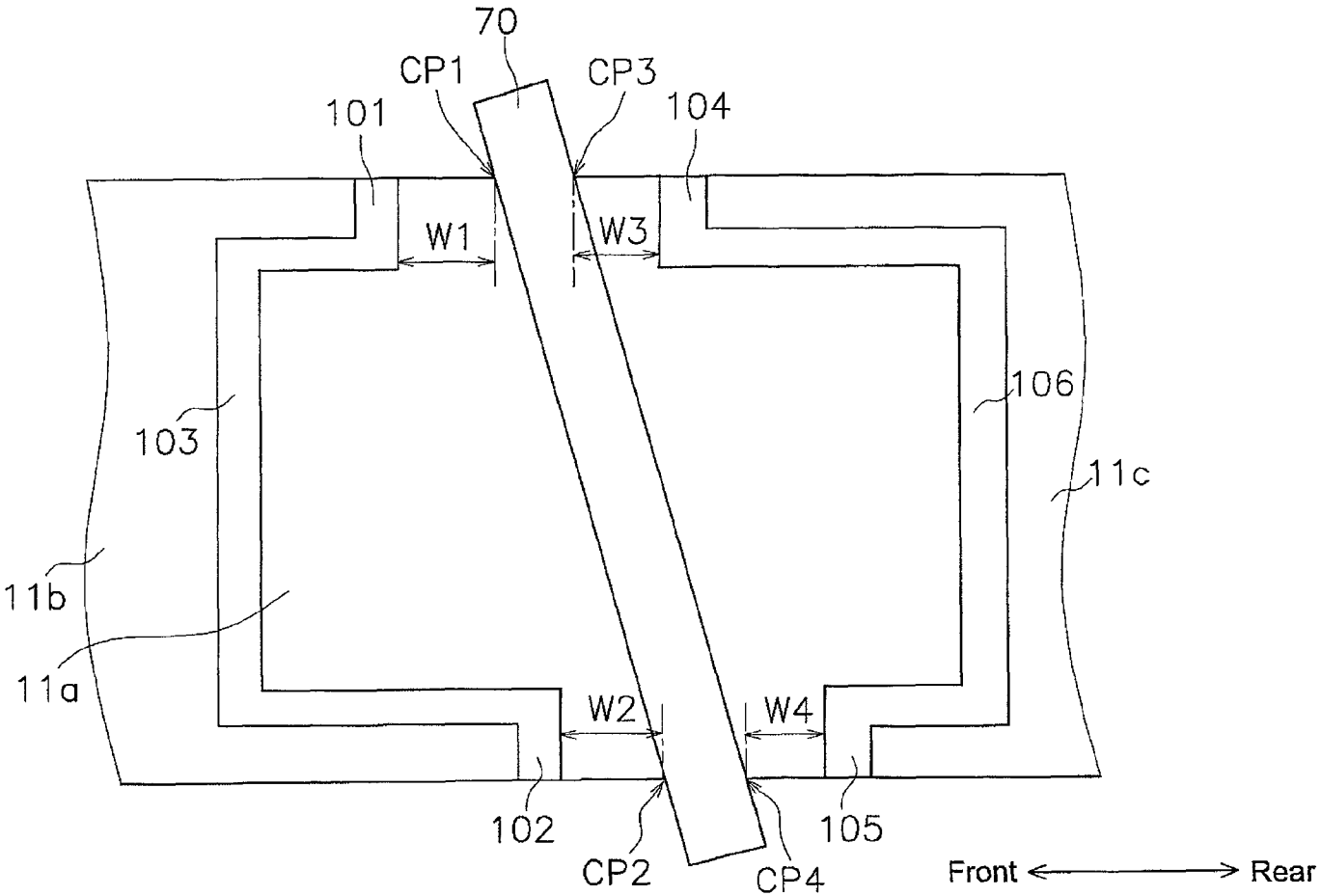
FIG. 7 is a side view of a state in which the first and second frame parts are welded to the bracket.

FIG. 5 is a perspective view of a state in which the first and second frame parts 11*b*, 11*c* are coupled with the bracket 11*a*. FIG. 6 is a perspective view illustrating a state in which the first and second frame parts 11*b*, 11*c* are welded to the bracket 11*a*. FIG. 7 is a side view illustrating a state in which the first and second frame parts 11*b*, 11*c* are welded to the bracket 11*a*.

As illustrated in FIG. 5, when the first frame part 11*b* is coupled to the bracket 11*a*, a first gap D1 is formed between the bracket 11*a* and the first frame part 11*b*. Since the pair of forward projecting parts 100 is formed on the bracket 11*a*, the first gap D1 is formed at the rear side in the longitudinal direction with respect to the front projecting part 100 as seen from the side.

Similarly, when the bracket 11*a* and the second frame part 11*c* are coupled, a second gap D2 is formed between the bracket 11*a* and the second frame part 11*c*. Since the pair of rearward projecting parts 110 is formed on the bracket 11*a*, the second gap D2 is formed at the longitudinal direction front side with respect to the rear projecting part 110 as seen from the side.

As illustrated in FIG. 6, the first bead part 11*d* is formed due to welding along the first gap D1. The first bead part 11*d* is formed along the first gap D1. Specifically, the first bead part 11*d* includes first to third portions 101 to 103, and a pair of forward extension portions 111, 112. The first to third portions 101 to 103 are joined in order.

The first portion 101 is formed in the crosswise direction. The first portion 101 connects the top surface of the bracket 11*a* and the top surface of the first frame part 11*b*. The outer surface of the first portion 101 extends in a flat manner from the top surfaces of the bracket 11*a* and the first frame part 11*b*.

The second portion 102 is formed in the crosswise direction. The second portion 102 connects the bottom surface of the bracket 11*a* and the bottom surface of the first frame part 11*b*. The outer surface of the second portion 102 extends in a flat manner from the bottom surfaces of the bracket 11*a* and the first frame part 11*b*.

The third portion 103 is formed in the vertical direction. The third portion 103 connects the left side surface of the bracket 11*a* and the left side surface of the first frame part 11*b*. The outer surface of the third portion 103 extends in a flat manner from the left side surfaces of the bracket 11*a* and the first frame part 11*b*.

As illustrated in FIG. 7, the first portion 101 and the second portion 102 are separated from each other in the front-back direction. Specifically, the first portion 101 is located in front of the second portion 102. The third portion 103 is separated from both the first portion 101 and the second portion 102 in the front-back direction. Specifically, the third portion 103 is located in front of the first portion 101.

The lifter guide 70 is connected to the bracket 11*a* in a state in which the top part of the lifter guide 70 is bent forward (that is, in a forward slanting orientation). The front surface of the lifter guide 70 intersects the top surface and the bottom surface of the bracket 11*a* as seen from the side. Specifically, in a projection plane of the lifter guide 70 on to the bracket 11*a*, the front surface of the lifter guide 70 crosses the top surface of the bracket 11*a* at a first intersection CP1, and crosses the bottom surface of the bracket 11*a* at a second intersection CP2. In the present embodiment, a distance W1 between the first intersection CP1 and the first portion 101 is equal to a distance W2 from the second intersection CP2 to the second portion 102 in the front-back direction.

Although not shown, the first bead part 11*d* includes a bead part that connects the right side surface of the bracket 11*a* and the right side surface of the first frame part 11*b*.

Further, the second bead part 11*e* is formed by welding along the second gap D2. The second bead part 11*e* is formed along the second gap D2. Specifically, the second bead part 11*e* includes fourth to sixth portions 104 to 106, and a pair of rearward extension portions 113, 114. The fourth to sixth portions 104 to 106 are joined in order.

The fourth portion 104 is formed in the crosswise direction. The fourth portion 104 connects the top surface of the bracket 11*a* and the top surface of the second frame part 11*c*. The outer surface of the fourth portion 104 extends in a flat manner from the top surfaces of the bracket 11*a* and the second frame part 11*c*.

The fifth portion 105 is formed in the crosswise direction. The fifth portion 105 connects the bottom surface of the bracket 11*a* and the bottom surface of the second frame part 11*c*. The outer surface of the fifth portion 105 extends in a flat manner from the top surfaces of the bracket 11*a* and the second frame part 11*c*.

The sixth portion 106 is formed in the vertical direction. The sixth portion 106 connects the left side surface of the bracket 11*a* and the left side surface of the second frame part 11*c*. The outer surface of the sixth portion 106 extends in a flat manner from the left side surfaces of the bracket 11*a* and the second frame part 11*c*.

As illustrated in FIG. 7, the fourth portion 104 and the fifth portion 105 are separated from each other in the front-back direction. Specifically, the fourth portion 104 is located in front of the fifth portion 105. The sixth portion 103 is separated from both the fourth portion 104 and the fifth portion 105 in the front-back direction. Specifically, the sixth portion 106 is located to the rear of the fifth portion 105.

The rear surface of the lifter guide 70 intersects the top surface and the bottom surface of the bracket 11*a* as seen from the side. Specifically, in a projection plane of the lifter guide 70 on to the bracket 11*a*, the rear surface of the lifter guide 70 crosses the top surface of the bracket 11*a* at a third intersection CP3, and crosses the bottom surface of the bracket 11*a* at a fourth intersection CP4. In the present embodiment, a distance W3 between the third intersection CP3 and the fourth portion 104 is equal to a distance W4 from the fourth intersection CP4 to the fifth portion 105 in the front-back direction. The distance W3 between the third intersection CP3 and the fourth portion 104 may also be equal to the distance W1 between the first intersection CP1 and the first portion 101.

Although not shown, the second bead part 11*e* includes a bead part that connects the right side surface of the bracket 11*a* and the right side surface of the second frame part 11*c*.

(Characteristics)

The frame 10 of the motor grader 1 includes the bracket 11*a* fixed to the lifter guide 70, the first frame part 11*b* that extends forward from the front end part of the bracket 11*a*, and the second frame part 11*c* that extends rearward from the rear end part of the bracket 11*a*.

Therefore, there is no need to provide a large device for fixing the lifter guide 70 to the frame 10 since there is no need to insert the lifter guide 70 through the frame 10. Moreover, since the lifter guide 70 is positioned by coupling the bracket 11*a* with the first and second frame parts 11*b*, 11*c*, the positional accuracy of the lifter guide 70 on the frame 10 can be improved. Further, there is no need to provide a plate member for filling in the gap between the lifter guide 70 and the frame 10 since the lifter guide 70 is fixed to the bracket 11*a*. Due to the above configuration, the lifter guide 70 can be fixed to the frame 10 with good accuracy and with ease.

(2) The lifter guide 70 and the bracket 11*a* are cast metals formed in an integrated manner.

Therefore, the strength of the attachment of the lifter guide 70 to the frame 10 can be improved in comparison to when the lifter guide 70 is welded to the bracket 11*a*. Specifically, since the first and second bead parts 11*d*, 11*e* can be separated from the lifter guide 70, the concentration of an external force applied to the lifter guide 70 on the first and second bead parts 11*d*, 11*e* can be suppressed.

(3) The first to third portions 101 to 103 of the first bead part 11*d* are separated in the front-back direction.

Therefore, the concentration of an external force applied to the lifter guide 70 can be suppressed in comparison to when the first to third portions 101 to 103 are formed in a linear manner as seen from the side. In particular, the effect of reducing a torsional force is achieved.

The effect can be achieved in the same way due to the separation in the front-back direction of the fourth to sixth portions 104 to 106 of the second bead part 11*e*.

(4) The first portion 101 is located in front of the second portion 102. Therefore, the concentration of an external force on the first bead part 11*d* can be suppressed. Similarly, the fourth portion 104 is located in front of the fifth portion 105. Therefore, the concentration of an external force on the second bead part 11*e* can be suppressed.

(5) The distance W1 between the first intersection CP1 and the first portion 101 is equal to the distance W2 from the second intersection CP2 to the second portion 102 in the front-back direction. Therefore, the concentration of an external force on the first bead part 11*d* can be suppressed.

Similarly, the distance W3 between the third intersection CP3 and the fourth portion 104 is equal to the distance W4 from the fourth intersection CP4 to the fifth portion 105 in the front-back direction. Therefore, the concentration of an external force on the first bead part 11*d* can be suppressed.

(6) The third portion 103 is separated from both the first portion 101 and the second portion 102 in the front-back direction. Therefore, the concentration of an external force on the first bead part 11*d* can be suppressed in comparison to when the third portion 103 is joined in a linear manner with the first portion 101 and the second portion 102 as seen from the side.

Similarly, the sixth portion 106 is separated from both the fourth portion 104 and the fifth portion 105 in the front-back direction. Therefore, the concentration of an external force on the second bead part 11*e* can be suppressed in comparison to when the sixth portion 106 is joined in a linear manner with the fourth portion 104 and the fifth portion 105 as seen from the side.

(7) The outer surface of the first bead part 11*d* is coupled in a flat manner with the outer surfaces of the bracket 11*a* and the first frame part 11*b*.

Therefore, the concentration of an external force applied to the lifter guide 70 on the first bead part 11*d* can be further suppressed in comparison to when the outer surface of the first bead part 11*d* projects outward from the outer surfaces of the bracket 11*a* and the first frame part 11*b*.

The effect is achieved in the same way due to the outer surface of the second bead part 11*e* being coupled in a flat manner with the outer surfaces of the bracket 11*a* and the second frame part 11*c*.

Other Embodiments

Although an embodiment of the present invention has been described so far, the present invention is not limited to the above embodiments and various modifications may be made within the scope of the invention.

While the lifter guide 70 is described as an annular member in the above embodiment, the present invention is not limited as such. The lifter guide 70 may be an L-shaped member or a U-shaped member.

(B) While the lifter guide 70 and the bracket 11*a* are described as a cast metal formed in an integrated manner in the above embodiment, the present invention is not limited as such. The lifter guide 70 and the bracket 11*a* may be formed separately and may be connected by welding. Even in such as case, the positional accuracy of the lifter guide 70 is easily improved. Moreover, since the bracket 11*a* can be inserted through the lifter guide 70 even if the gap between the lifter guide 70 and the bracket 11*a* is narrow, plate members for filling in the gap can be reduced.

(C) While the pair of forward projecting parts 100 and the pair of rearward projecting parts 110 are formed by extending both side plates of the bracket 11*a* forward and rearward in the above embodiment, the present invention is not limited as such. The pair of forward projecting parts 100 and the pair of rearward projecting parts 110 may be formed by extending the top and bottom plates of the bracket 11*a* forward and rearward. The bracket 11*a* may not include the pair of forward projecting parts 100 or the pair of rearward projecting parts 110, and may only include one each of the forward projecting part 100 and the rearward projecting part 110.

Figure 8:
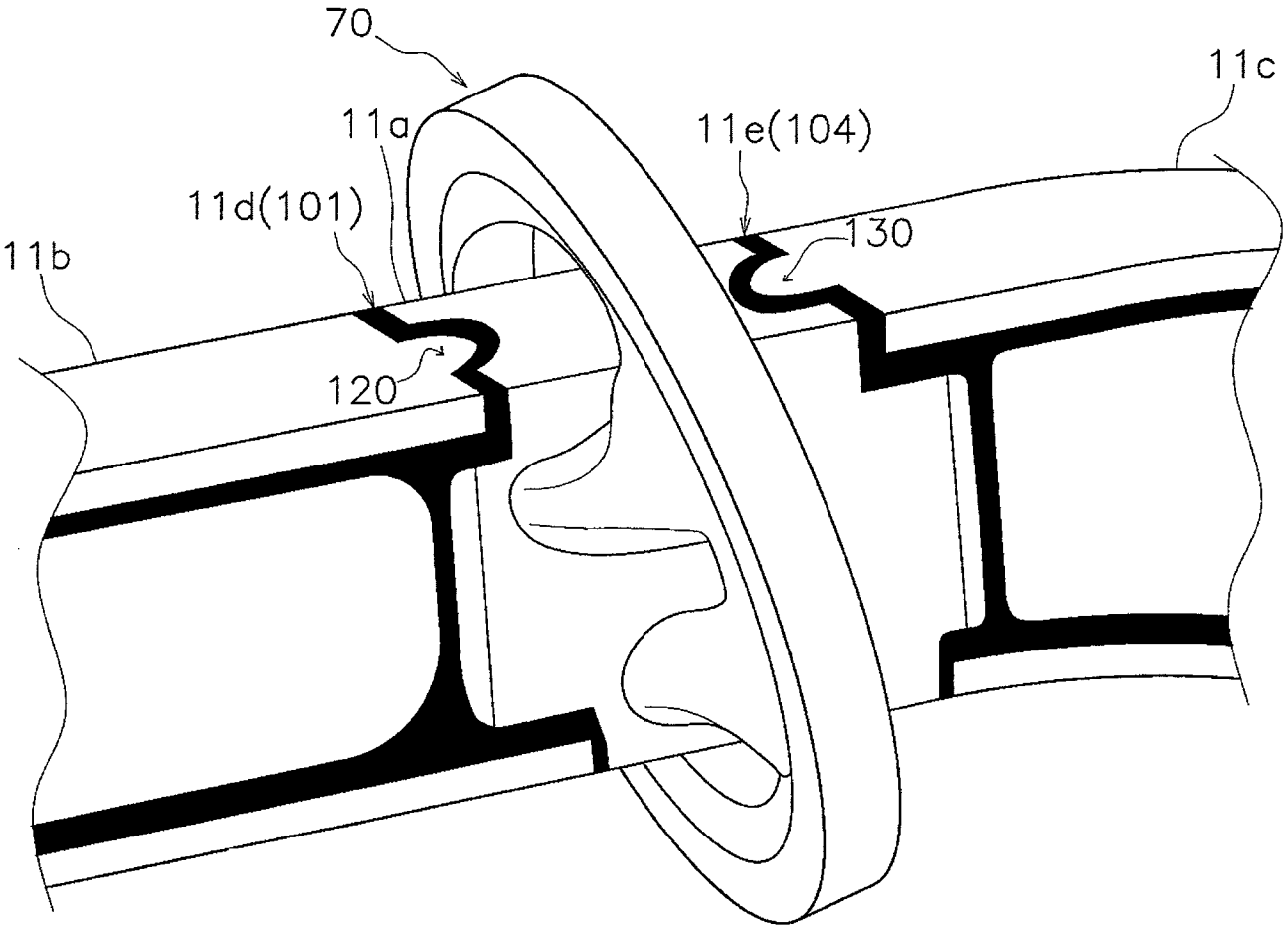
FIG. 8 is a perspective view of a state in which the first and second frame parts are welded to the bracket.
Figure 9:
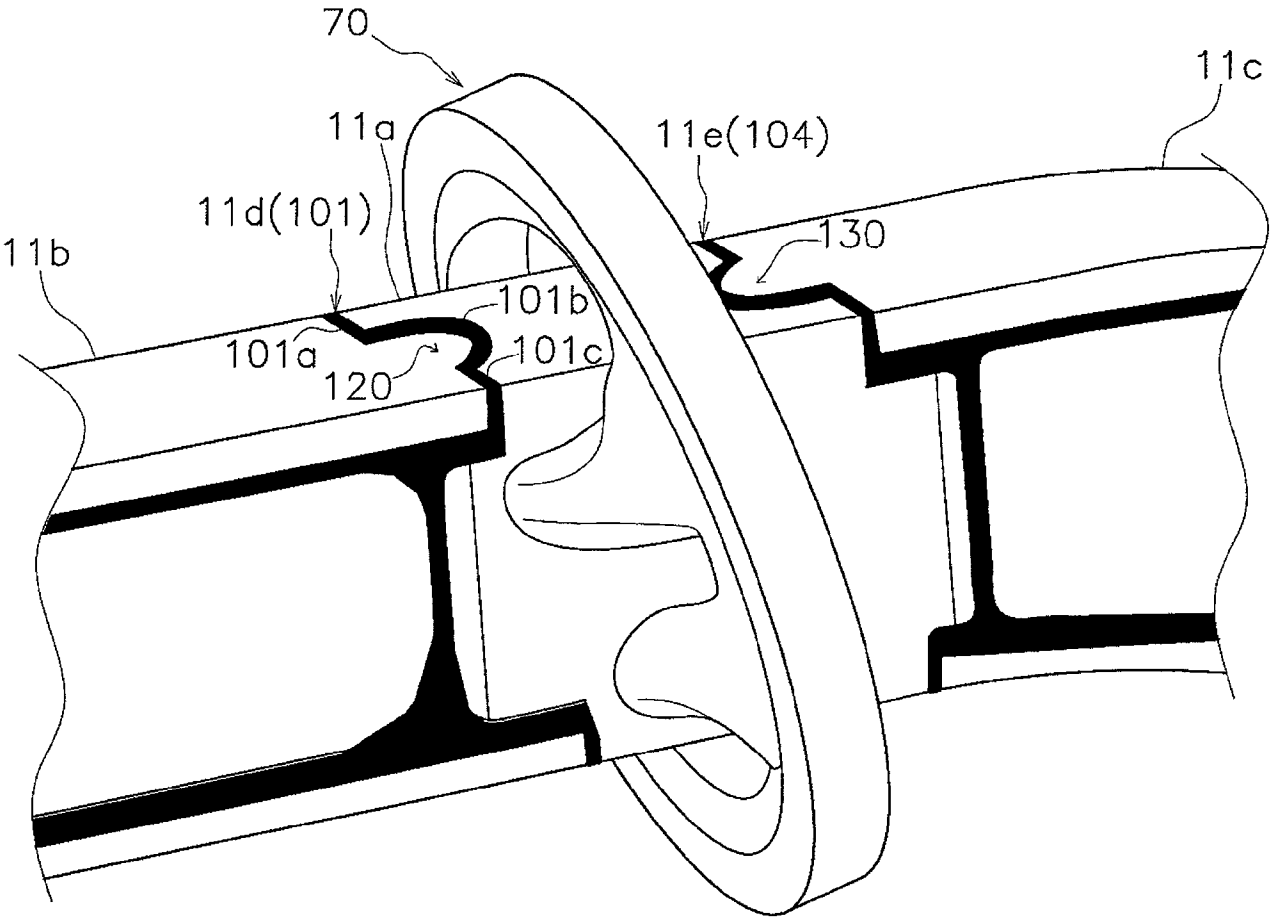
FIG. 9 is a perspective view of a state in which the first and second frame parts are welded to the bracket.

(D) While the first portion 101 of the first bead part 11*d* is formed in a linear manner in the crosswise direction in the above embodiment, at least a portion of the first portion 101 may be formed in a curved manner. For example, as illustrated in FIG. 7, the center portion of the first portion 101 may be curved toward the rear so as to correspond to the rearward projecting part 120 provided in the second frame part 11*b*. In this case, the front-back location of the left and right end parts of the first portion 101 may be shifted. Further, as illustrated in FIG. 8, if the first portion 101 is configured as a first linear section 101*a*, a curved part 101*b*, and a second linear section 101*c*, the first linear section 101*a* and the second linear section 101*c* may not be in a straight line. The first linear section 101*a* is provided forward of the second linear section 101*c* in the example illustrated in FIG. 8. The shape of the curved part 101*b* may be altered in accordance with the shape of the rearward projecting part 120.

Similarly, as illustrated in FIGS. 7 and 8, at least a portion of the fourth portion 104 of the second bead part 11*e* may be formed in a curved shape in accordance with the forward projecting part 130 of the third frame part 11*c*.

(E) while the lifter guide 70 is connected to the bottom surface and the left and right side surfaces of the bracket 11*a* in the above embodiment, the lifter guide 70 may not be connected to the left and right side surfaces of the bracket 11*a*. The lifter guide 70 may also be connected to the top surface of the bracket 11*a*.

INDUSTRIAL APPLICABILITY

The present invention is useful in the field of motor graders since the lifter guide can be fixed easily and accurately to the frame.

What is claimed is:

1. A motor grader comprising:

a box-shaped frame;

a work implement configured to be supported by the frame, and a first bead part, the frame including a bracket, a first frame part and a second frame part, the bracket having left and right side surfaces with which a lifter guide is formed in an integrated manner, the lifter guide being configured to support a lift cylinder that moves the work implement, a lifter bracket configured to encircle the lifter guide, and a cylinder configured to be coupled to the lifter bracket and the work implement, the first frame part being configured to extend forward from a front end part of the bracket and support the work implement, the second frame part being configured to extend rearward from a rear end part of the bracket, the first frame part being directly connected to the front end part of the bracket, the second frame part being directly connected to the rear end part of the bracket, the first bead part being configured to connect the bracket and the first frame part, and including a first portion, a second portion and a third portion, the first portion being configured to extend in a crosswise direction and connect a top surface of the bracket and a top surface of the first frame part, the second portion being configured to extend in the crosswise direction and connect a bottom surface of the bracket and a bottom surface of the first frame part, the third portion being configured to extend in a vertical direction and connect one of the left and right side surfaces of the bracket and a side surface of the first frame part, the third portion being substantially perpendicular to the first and second portions, and the first portion and the second portion being offset from each other in a first direction perpendicular to a second direction in which the third portion extends.

2. The motor grader according to claim 1, wherein the lifter guide and the bracket are a cast metal.

3. The motor grader according to claim 1, wherein the first portion is located further toward a front of the frame than the second portion.

4. The motor grader according to claim 3, wherein the lifter guide is connected to the bracket with a top part of the lifter guide bent forward, and a distance of the first portion from an intersection between a projection plane of the lifter guide onto the bracket and a top surface of the bracket is equal to a distance of the second portion from an intersection between a projection plane of the lifter guide onto the bracket and a bottom surface of the bracket.

5. The motor grader according to claim 1, wherein the third portion is separated from the first portion and the second portion along a front-back direction.

6. The motor grader according to claim 1, wherein an outer surface of the first bead part is coupled in a flat manner with an outer surface of the bracket and an outer surface of the first frame part.

7. The motor grader according to claim 1, further comprising:

a second bead part configured to connect the bracket and the second frame part, the second bead part including a fourth portion, a fifth portion and a sixth portion, the fourth portion being configured to extend in a crosswise direction and connect a top surface of the bracket and a top surface of the second frame part, the fifth portion being configured to extend in the crosswise direction and connect a bottom surface of the bracket and a bottom surface of the second frame part, the sixth portion being configured to extend in a vertical direction and connect one of the left and right side surfaces of the bracket and a side surface of the second frame part, and the fourth portion and the fifth portion being separated from each other along a direction perpendicular to the direction in which the sixth portion extends.

8. The motor grader according to claim 7, wherein the fourth portion is located further toward a front of the frame than the fifth portion.

9. The motor grader according to claim 8, wherein
the lifter guide is connected to the bracket with a top part of the lifter guide bent forward, and
a distance of the fourth portion from an intersection between a projection plane of the lifter guide onto the bracket and a top surface of the bracket is equal to a distance of the fifth portion from an intersection between a projection plane of the lifter guide onto the bracket and a bottom surface of the bracket.

10. The motor grader according to claim 7, wherein
the sixth portion is separated from the fourth portion and the fifth portion along a front-back direction.

11. The motor grader according to claim 7, wherein
an outer surface of the second bead part is coupled in a flat manner with an outer surface of the bracket and an outer surface of the second frame part.

12. The motor grader according to claim 1, wherein:
the lifter guide has an annular shape.

13. The motor grader according to claim 1, wherein
the lifter guide is formed on a bottom surface and the right and left side surfaces of the bracket.

* * * * *